United States Patent [19]

Tomioka et al.

[11] Patent Number: 4,722,857

[45] Date of Patent: Feb. 2, 1988

[54] REINFORCED NON-WOVEN FABRIC

[75] Inventors: Susumu Tomioka, Shigaken; Shozo Sone, Kawanoeshi, both of Japan

[73] Assignees: Chisso Corporation, Osaka; Fukusuke Kogyo Corporation; Fukuron Corporation, both of Ehimeken, all of Japan

[21] Appl. No.: 21,353

[22] Filed: Mar. 3, 1987

[30] Foreign Application Priority Data

Mar. 4, 1986 [JP] Japan ..... 61-46813

[51] Int. Cl.[4] ..... D04H 1/04

[52] U.S. Cl. ..... 428/113; 428/198; 428/236; 428/286; 428/293; 428/294; 428/296; 156/177; 156/179; 156/181; 156/285; 156/308.2

[58] Field of Search ..... 428/113, 236, 286, 293, 428/294, 296, 198; 156/177, 179, 181, 285, 308.2

[56] References Cited

U.S. PATENT DOCUMENTS

| | | | |
|---|---|---|---|
| 4,522,863 | 6/1985 | Keck et al. | 428/296 |
| 4,592,943 | 6/1986 | Cancian | 428/296 |
| 4,661,389 | 4/1987 | Mudge et al. | 428/296 |

FOREIGN PATENT DOCUMENTS 61-41357 2/1986 Japan .

*Primary Examiner*—Marion C. McCamish
*Attorney, Agent, or Firm*—Leydig, Voit & Mayer

[57] ABSTRACT

The present invention provides a reinforced non-woven fabric comprising a web containing at least 15% by weight of composite fiber composed of a low-melting component and a high-melting component, the low-melting component forming at least a part of the external fiber surface, first reinforcing fibers arranged obliquely to the lengthwise direction of the web, and second reinforcing fibers crossed with the first reinforcing fibers for symmetric arrangement relative to the lengthwise direction of the web, the first and second reinforcing fibers containing at least 15% by weight of hot-melt-adhesive fiber hot-melt-adhered in the heat treatment conducted for forming the non-woven fabric at a temperature between the melting point of the high-melting component and that of the low-melting component of the hot-melt-adhesive composite fiber. The first and second reinforcing fibers, these fibers and the web and the fibers constituting the web are bonded to each other by heat fusion and the reinforcing texture having a diamond pattern constituted by the first and second reinforcing fibers is at least partly embedded in the non-woven fabric.

2 Claims, 2 Drawing Figures

REINFORCED NON-WOVEN FABRIC

BACKGROUND OF THE INVENTION

1. Field of the Invention:

This invention relates to a reinforced non-woven fabric and, more particularly to a high-tenacity non-woven fabric suited for use as materials for packaging, medical supplies or the like.

2. Description of the Prior Art:

There are known various types of non-woven fabrics reinforced with yarns, slit films or textiles composed thereof. Japanese Patent Publication Nos. 20567/77 and 5879/81 have disclosed a method of reinforcing non-woven fabrics with a net-like texture. According to this method, a desired number of sheets of non-woven fabric, which have been prepared beforehand, are placed in layers with a previously prepared heat-fusible net-like texture sandwiched between every adjoining layers of non-woven fabric, and the layers are bonded to each other by heated rolls. This method, however, involves a time-consuming production process, which leads to a high production cost. Also, the obtained product tends to suffer from separation at the bonded areas because of the face-to-face bonding of the net-like texture and non-woven fabric, and more solid and strong bonding leads to a worsened feeling of the product. In the conventional reinforced non-woven fabrics, reinforcing yarns are interwoven in the lengthwise direction of the non-woven fabric and in the direction orthogonal thereto, so that in such reinforced non-woven fabrics, a great deal of improvement may be provided in terms of tenacity and dimensional stability in both lengthwise and breadthwise directions, but the produced fabrics are poor in stretchability in both lengthwise and transverse directions, thereby giving rise to the problems that when tensile force is exerted to the non-woven fabric, such force is not absorbed elastically, or the non-woven fabric is ripped at the interstices of the reinforcing texture.

SUMMARY OF THE INVENTION

The object of the present invention is to solve said problems of the conventional reinforced non-woven fabrics and to provide a reinforced non-woven fabric having high fiber adhesion and tenacity and enough stretchability to enable absorption of tension in both lengthwise and transverse directions and low in cost.

The reinforced non-woven fabric according to the present invention comprises a web containing at least 15% by weight of composite fiber (which may hereinafter be referred to as hot-melt-adhesive composite fiber) consisting of a low-melting component and a high-melting component, said low-melting component forming continuously at least a part of the external fiber surface, first reinforcing fibers arranged obliquely to the lengthwise direction of said web, and second reinforcing fibers crossed with said first reinforcing fibers for symmetric arrangement relative to the lengthwise direction of the web, said first and second reinforcing fibers containing at least 15% by weight of fiber (which may hereinafter be referred to as hot-melt adhesive fiber) which is hot-melt-adhered in the heat treatment conducted for forming the non-woven fabric at a temperature between the melting point of the high-melting component and that of the low-melting component of said hot-melt-adhesive composite fiber (these reinforcing fibers may hereinafter be referred to as hot-melt-adhesive reinforcing fiber), wherein the first and second hot-melt-adhesive reinforcing fibers, these reinforcing fibers and the web, and the fibers composing the web are bonded to each other by means of heat fusion, and the reinforcing texture having a diamond pattern constituted by said first and second hot-melt-adhesive reinforcing fibers is at least partly embedded in the non-woven fabric.

The above-mentioned and other objects and features of the invention will become apparent from the following detailed description taken in conjunction with the drawings which indicate embodiments of the invention.

DETAILED DESCRIPTION OF PREFERRED EMBODIMENTS

Figure 1:
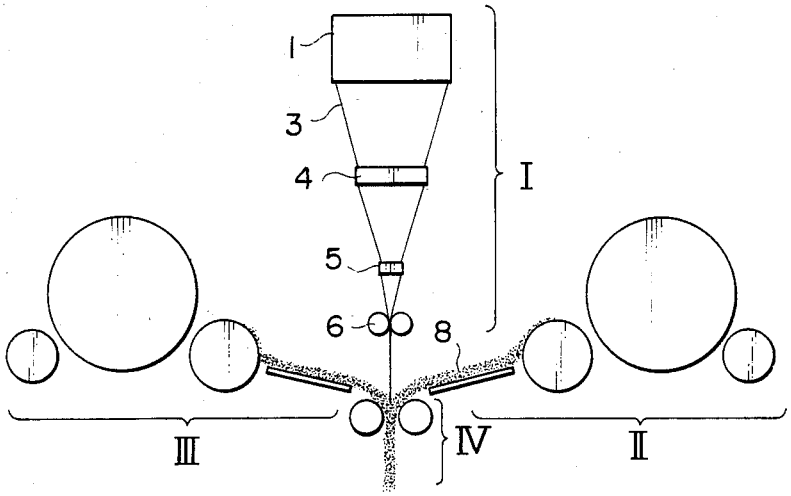
FIG. 1 is a schematic illustration of an apparatus for producing a reinforced non-woven fabric according to the present invention.

FIG. 1 illustrates a reinforced non-woven fabric producing apparatus schematically as viewed from a side thereof. In the drawing, reference numeral (I) designates reinforcing fiber feeding section, (II) and (III) web feeding section, and (IV) reinforced non-woven fabric forming section.

Figure 2:
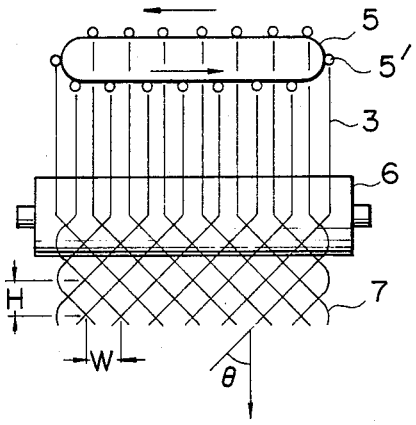
FIG. 2 is an enlarged view of a part of a reinforced fabric feeding section shown in FIG. 1.

FIG. 2 is an enlarged view of a part of the reinforced fabric feeding section as taken from the direction orthogonal to FIG. 1. Reinforcing fibers 3 delivered out from a plurality of bobbins 2 (not shown) built in a drum 1 are passed through control guides 4' (not shown) in a tension control unit 4 and drag-in guides 5' in a drag-in unit 5 and taken up by nip rolls 6. The drum 1, tension control unit 4 and drag-in unit 5 are arranged to rotate synchronously with each other in the same direction. The control guides 4' give an adequate resistance to filament passage for feeding the reinforcing fibers 3 under proper tension to the nip rolls 6. The drag-in unit 5 is designed to supply the reinforcing fibers 3 at suitable intervals within the effective span of the nip rolls 6. It comprises an endless flexible support frame such as chain, wire, thin plate, etc., mounted with the drag-in guides 5' suitably spaced-apart from each other, said support frame being preferably arranged in a flat and circular configuration so that the longer axis will stay within the effective span of the nip rolls 6. At least one of said nip rolls 6 is a heating roll having a metallic surface. In FIG. 2, only one roll is shown.

In FIG. 2, the fore portion of the drag-in unit 5 moves from left to right while the rear portion moves from right to left. Therefore, the reinforcing fibers 3 guided by the drag-in guides 5' are caused to cross each other at fixed intervals on the nip rolls 6 and hot-melt-adhered at the crossing points to form a reinforcing texture 7 having a diamond pattern symmetrical sidewise relative to the fiber moving direction. The pitch (H) of the diamond pattern in the moving direction is decided by the ratio of take-up rate of the nip rolls 6 to rotating speed of the drag-in unit, hence the pitch is narrowed as the rotating speed of the drag-in unit is raised. When the pitch in the moving direction is narrowed, the angle ($\theta$ in FIG. 2) made by each reinforcing fiber with the moving direction is enlarged accordingly. This increases the stretchability of the reinforced non-woven fabric in the lengthwise direction but the strength in this direction is lowered, while the stretchability in the transverse direction is reduced but the strength in this direction is increased. Therefore, said pitch needs to be selected appropriately according to the purpose of use of the produced reinforced non-woven fabric, but usually the proper range of said angle ($\theta$) is 10° to 80°. The pitch (W) in the widthwise direction is decided by the interval of the drag-in guides.

In the present invention, the reinforcing fiber 3 contains at least 15% by weight of hot-melt-adhesive fiber described below, and hot-melt-adhering by the nip rolls 6 is carried out at a temperature above the softening point of said hot-melt-adhesive fiber.

The term "hot-melt-adhesive fiber" used in this specification refers to the fiber which can be softened or fused at the temperature of heat treatment conducted for forming non-woven fabric in the succeeding step. By containing at least 15% by weight of this hot-melt-adhesive fiber in the reinforcing fiber, the reinforcing fiber itself is strengthened by heat fusion and a net-like texture is constituted as they are hot-melt-adhered by said nip rolls 6. Further, strong bond is provided by hot-melt-adhesion between the fibers composing the web, which is the main constituent of the non-woven fabric, in the heat treatment for forming the non-woven fabric. This adds to the improvement of tenacity of the non-woven fabric. As the hot-melt-adhesive fiber, it is preferred to use a fiber composed of only the low-melting component of the hot-melt-adhesive composite fiber contained in the web as such fiber can provide high adhesion between the reinforcing fiber and the web.

A web 8, which is another component material of the reinforced non-woven fabric, is supplied from web feeding sections (II, III). This web can be obtained by a method usually used for the production of dry non-woven fabrics, such as carding method, dry pulp method, air-laied method, etc. FIG. 1 is a schematic illustration of a simultaneous feed system according to the carding method. In the drawing, there are shown two sets of web feeding section, of which one may be omitted.

The web contains at least 15% by weight of composite fiber (which may hereinafter be referred to as hot-melt-adhesive composite fiber) consisting of a low-melting component and a high-melting component, said low-melting component forming at least a part of the external surface of fiber successively. The resins used in combination as both components of the hot-melt-adhesive composite fiber have preferably the difference in melting point which is at least 20° C. If the difference in melting point is less than 20° C., it is difficult to conduct the heat treatment at a temperature between the melting points of said both resins for forming the non-woven fabric. Examples of the preferred resin combinations are polypropylene and polyethylene, propylene and ethylene-butene copolymer, polypropylene and ethylene-vinyl acetate copolymer or its saponified product, nylon 66 and nylon 6, polyester and copolyester, and polyester and polystyrene.

In order that said composite fiber is heat fusible owing to its low-melting component, it is necessary that said component forms at least a part of the fiber surface. Therefore, in case of using side by side type composite fiber, such fiber should be one in which the low-melting component holds at least 30%, usually 50% or more of the whole circumference of a cross section of the fiber. It is also possible to use an approximately 100% or perfectly sheath-core type fiber. The web may be composed of this hot-melt-adhesive composite fiber alone or a mixture thereof with other type of fiber. As other type of fiber, there can be used synthetic fiber, natural fiber, pulp or the like as far as they won't be deformed or denatured at the heat treatment temperature for forming the non-woven fabric. If the amount of hot-melt-adhesive composite fiber in the web is less than 15% by weight, the stabilization of the non-woven fabric proves insufficient and also adhesion to the reinforcing fiber is unsatisfactory, resulting in low tenacity of the produced non-woven fabric.

Said reinforcing texture and web are laminated in the reinforced non-woven fabric forming section and subjected to a heat treatment under pressure at a temperature above the softening point of the low-melting component of the hot-melt-adhesive composite fiber and below the melting point (preferably below the softening point) of the high-melting component. By this treatment, the fibers constituting the web are adhered to each other by heat fusion and at the same time the web and reinforcing texture are also similarly adhered to each other to form a reinforced non-woven fabric of the present invention. For the process of said heat treatment for forming the non-woven fabric, there is preferably employed hot calendering for the non-woven fabric with a low METSUKE (weight per unit area) and a suction drying method for the non-woven fabric with a medium or high METSUKE. Whichever method is used, it is necessary to press adhere the laminate of reinforcing net-like texture and web at the time of the heat treatment. The pressure to be applied for such press adhering depends on the amount of the hot-melt-adhesive fiber in the reinforcing fiber, the amount of the hot-melt-adhesive composite fiber in the web and the METSUKE of the reinforced non-woven fabric, but it usually suffices to apply a pressure of at least 10 kg/cm as linear pressure. By this press adhering treatment, the reinforcing texture, at least a part thereof, is embedded in the non-woven fabric and enhanced in peel resistance of the fabric.

In said heat treatment, other non-woven fabric, paper or the like may be laminated and adhered together with said reinforcing texture and web.

The present invention will be described in further detail below with reference to the examples and comparative examples. The following testing methods were used for the evaluations of the product in each example.

Tenacity and stretchability:

A test piece of 5 cm in width and 20 cm in length was pulled at a constant pulling rate of 10 cm/min through a test length of 10 cm by using a tensile tester, and the stress and elongation at the breaking point were measured.

Tension at 1% elongation:

The tension at 1% elongation was read from the stress/strain curve in the measurement of said tenacity and stretchability.

Bending resistance:

A 2.5 cm wide test piece placed on a flat plate positioned at a height of 2.5 cm above a base was slowly pushed out from the end of said flat plate, and when the end of the pushed-out test piece came into contact with the base 2.5 cm below said flat plate, the horizontal distance between the end of the test piece and the end of said flat plate was measured. The same test was conducted on five test pieces. From the mean value $l_1$ obtained with the reinforced non-woven fabric and the mean value $l_0$ obtained with the non-woven fabric made by using a web of the same composition as said reinforced non-woven fabric but not using reinforcing fibers, $R=(l_1-l_0)/l_0$ was calculated, and evaluation was made on the following criterion:

$R \leqq 0.35$: Good (Change of feeling was scarce)

$0.35 < R \leqq 0.6$: Bad (Change of feeling was noted)

$0.6 < R$: Poor (Feeling was hard)

Peel resistance:

A test piece of 5 cm in width and 10 cm in length was rumpled 20 times by holding with hands both ends of the test piece, leaving the 5 cm central portion, and after that, the surface of the test piece was observed. The same test was conducted on five test pieces of each specimen. In case no rise-up of reinforcing fibers was seen in any of the five test pieces thus treated, the specimen was rated as 1 point; in case rise-up of fibers was seen in 1 to 2 test pieces, the specimen was rated as 2 points; and in case said rise-up was seen in 3 or more test pieces, the specimen was rated as 3 points. Further, when no fuzzing was seen on the surface, the specimen was rated as 1 point; when a slight degree of fuzzing was admitted on the surface, the specimen was rated as 2 points; and when heavy fuzzing was seen on the surface, the specimen was rated as 3 points. The specimen was judged as "good" when the product of both rating points was 1, "bad" when the product of both rating points was 2 and "poor" in other cases.

EXAMPLE 1

High-density polyethylene monofilaments (size: 100 deniers; melting point: 130° C.; softening point: 110° C.) were used as reinforcing fibers (hot-melt-adhesive fibers), and they were supplied to the nip rolls consisting of heated flat rolls and metal rolls through the drag-in guides disposed at an interval of 25 mm and passed between said nip rolls under the conditions of 130° C. and 90 kg/cm to form a reinforcing texture comprising said reinforcing fibers crossed at an angle of 45° against the direction of fiber movement. A card web (METSUKE: 35 g/m$^2$) composed of hot-melt-adhesive composite fibers (3 deniers×51 mm) alone made by using polypropylene (melting point: 168° C.; softening point: 145° C.) as core component and polyethylene (melting point: 130° C.; softening point: 110° C.) as sheath component in a ratio of 50:50 was combined with said reinforcing texture and passed through a heat treating apparatus consisting of heated flat rolls and rubber rolls (reinforced non-woven fabric forming section) under the conditions of 135° C. and 10 kg/cm to obtain a reinforced non-woven fabric. The property values of this reinforced non-woven fabric and those of a non-woven fabric obtained by heat treating the card web along without using the reinforcing fibers are shown in Table 1.

This reinforced non-woven fabric was provided with enough quality to be used as a packaging material for disposable body warmers.

COMPARATIVE EXAMPLES 1-1 TO 1-3

Propylene-ethylene copolymer monofilaments (size: 100 deniers; melting point: 160° C.; softening point: 140° C.) were used as reinforcing fibers, and they were supplied to the nip rolls consisting of heated flat rolls and metal rolls through the drag-in guides disposed at an interval of 25 mm and passed between said nip rolls under the conditions of 150 °C. and 90 kg/cm to form a reinforcing texture comprising said reinforcing fibers crossed at an angle of 45° against the direction of fiber movement. A card web identical with that used in Example 1 was combined with said reinforcing texture and passed through the same heat treating apparatus as used in Example 1 under the conditions of 135° C. and 50 kg/cm to obtain a reinforced non-woven fabric (Comparative Example 1-1). This reinforced non-woven fabric was weak in adhesion between the reinforcing texture and the web, and they were subject to easy separation. Another reinforced non-woven fabric obtained in the same way as described above except for change of the heat treatment conditions to 150° C. and 70 kg/cm (Comparative Example 1-2) had an unevenness in thickness due to heat shrinkage of the web and was hard in feeling and also lower in tenacity than the non-woven fabric of Example 1. There was also obtained a reinforced non-woven fabric (comparative Example 1-3) in the same way as Comparative Example 1-1 described above except that a fabric-like texture (Nisseki WARIFU SS, 18 g/m$^2$ in METSUKE) using polyethylene flat yarns for both warp and weft was used as the reinforcing texture. This reinforced non-woven fabric was stiff and hard in feeling. Further because of no stretchability in both lengthwise and breadthwise directions, it was unable to absorb the tensile force exerted thereto. When this non-woven fabric was bent while applying the tension, it was partly ripped at the meshes of the reinforcing texture. The property values of these comparative reinforced non-woven fabrics, Comparative Examples 1-1 to 1-3, are also shown in Table 1.

EXAMPLE 2

Used as reinforcing fibers were the blended yarns (yarn number: 25/1) consisting of 85% by weight of polyester fiber (1.5 deniers×51 mm) and 15% by weight of hot-melt-adhesive fiber (hot-melt-adhesive composite fiber) (1.5 deniers×51 mm) which was an eccentric composite fiber made by using polypropylene (melting point: 168° C.; softening point: 145° C.) as core component and polyethylene (melting point: 130° C.; softening point: 110° C.) as sheath component in a ratio of 50:50. Said blended yarns were supplied to the nip rolls consisting of heated flat rolls and metal rolls through the drag-in guides disposed at an interval of 20 mm, and passed between said nip rolls under the conditions of 145° C. and 100 kg/cm to form a reinforcing texture comprising the reinforcing fibers crossed at an angle of 30° against the direction of fiber movement. A card web (METSUKE: 15 g/m$^2$ ) composed of said hot-melt-adhesive composite fibers alone was joined with said reinforcing texture and passed through a heat treating apparatus consisting of heated embossing rolls and heated metal rolls under the conditions of 140° C. and 80 kg/cm to obtain a reinforced non-woven fabric.

The property values of this reinforced non-woven fabric are shown in Table 1. This reinforced non-woven fabric had a soft feeling and was suited for use as a cover material for throwaway diaper for adults.

COMPARATIVE EXAMPLE 2

A reinforced non-woven fabric was produced under the same conditions as in Example 2 except that the blending ratio of reinforcing fibers was changed to 12% by weight of hot-melt-adhesive fiber and 88% by weight of polyester fiber. This reinforced non-woven fabric was weak in adhesion between the reinforcing fibers themselves and between the reinforcing fibers and the web, and peeling thereof was seen in parts. The property values of this reinforced non-woven fabric are shown in Table 1. A follow-up test was conducted by raising the nip roll temperature for forming the reinforcing texture and the heat treatment temperature for forming the reinforced non-woven fabric by 30° each, but peeling of fibers from each other or from the web was still observed.

EXAMPLE 3

Monofilaments (200 deniers) made by using polypropylene (melting point: 168° C.; softening point: 145° C.) as core component and polyethylene (melting point: 130° C.; softening point: 110° C.) as sheath component in a ratio of 50:50 were used as reinforcing fibers (hot-melt-adhesive fibers), and they were supplied to the nip rolls consisting of heated flat rolls and rubber rolls through the drag-in guides disposed at an interval of 10 mm and passed between said nip rolls under the conditions of 130° C. and 50 kg/cm to form a reinforcing texture comprising said reinforcing fibers crossed at an angle of 30° against the direction of fiber movement. A card web, 35 g/m$^2$ in METSUKE, consisting of hot-melt-adhesive composite fiber and polyester fiber used in Example 2 and blended in a ratio of 15 to 85 by weight % was combined with said reinforcing texture and passed through a heat treating apparatus consisting of two heated flat rolls under the conditions of 140° C. and 90 kg/cm to obtain a reinforced non-woven fabric. The property values of this reinforced non-woven fabric are shown in Table 1. This reinforced non-woven fabric had the properties suited for use as victoria lawn for farm work.

COMPARATIVE EXAMPLE 3

A reinforced non-woven fabric was obtained under the same conditions as in Example 3 except that the blending ratio of hot-melt-adhesive composite fiber to polyester fiber in the card web was changed to 12:88 by weight %. This reinforced non-woven fabric was poor in peel resistance, and partial peeling of the reinforcing texture was seen. The property values of this reinforced non-woven fabric are shown in Table 1. Said peeling could not be prevented even when the heat treatment temperature was raised by 30° C.

EXAMPLES 4-1 and 4-2

Used as reinforcing fibers were the spun yarns (yarn number: 25/1) composed only of hot-melt-adhesive fiber (hot-melt-adhesive composite fibers) (1.5 deniers×51 mm) made by using polyester (melting point: 258° C.; softening point: 238° C.) as core component and polyethylene (melting point: 130° C.; softening point: 110° C.) as sheath component in a ratio of 50:50. These yarns were supplied to the nip rolls consisting of heated flat rolls and cotton rolls through the drag-in guides disposed at an interval of 5 mm and passed between said nip rolls under the conditions of 135° C. and 50 kg/cm to form a reinforcing texture comprising said reinforcing fibers crossed at an angle of 10° against the direction of fiber movement. A card web, 15 g/m$^2$ in METSUKE, consisting of polyester fiber (2 deniers×51 mm) and said hot-melt-adhesive composite fiber and blended in a ratio of 50 to 50 by weight % was combined with said reinforcing texture and passed through a heat treating apparatus consisting of heated flat rolls and cotton rolls under the conditions of 140° C. and 50 kg/cm to obtain a reinforced non-woven fabric (Example 4-1). A similar reinforced non-woven fabric (Example 4-2) was obtained by following the same operations as described above except that the rotating speed of the drag-in section was increased to form a reinforcing texture comprising the reinforcing fibers crossed at an angle of 80° against the direction of fiber movement. The property values of these reinforced non-woven fabrics are shown in Table 1. The reinforced non-woven fabric of Example 4-1 had the properties suited for use as a strainer bag for kitchen sink and the reinforced non-woven fabric of Example 4-2 had the properties suited for use as a bandage.

COMPARATIVE EXAMPLE 4

A reinforced non-woven fabric was produced by performing the same operations as in Example 4-1 except that a plain weave fabric of 5 mm meshes in both warp and weft made by using the same reinforcing fibers as used in Example 4-1 was passed between the nip rolls under the same conditions as in Example 4 to form a reinforcing texture. This reinforced non-woven fabric was low in stretchability in both lengthwise and transverse directions and also poor in feeling. The property values thereof are shown in Table 1.

EXAMPLE 5

A card web (35 g/m$^2$ in METSUKE) identical with that used in Example 3, a reinforcing texture identical with that used in Example 3 and a card web (70 g/m$^2$ in METSUKE) composed of hot-melt-adhesive composite fibers alone used in Example 2 were laminated in that order and passed through a heat treating apparatus consisting of a suction dryer and wooden pinch rolls, in which the laminate was first passed through said dryer at 140° C. for 30 seconds and then passed between said pinch rolls under a pressure of 10 kg/cm, to obtain a reinforced non-woven fabric. The property values of the obtained fabric are shown in Table 1. This reinforced non-woven fabric had the properties befitting its use as an oil adsorbent or oil fence for eliminating oil floating on the water surface.

TABLE 1

| | Reinforcing texture | | | Non-woven fabric | | | | | | | |
|---|---|---|---|---|---|---|---|---|---|---|---|
| | | | | | | Tenacity (g/5 cm) | | Elongation (%) | | Tention at 1% elongation (g/5 cm) | |
| Example | Reinforcing fiber (Material:%) | Guide interval (mm) | Angle | Web (Material:%) | METSUKE (g/m$^2$) | Length-wise | Trans-verse | Length-wise | Trans-verse | Length-wise | Trans-verse |
| Ex. 1 | PE:100 | 25 | 45 | PP/PE:100 | 35 | 6,540 | 730 | 38 | 42 | 361 | 49 |
| Comp. ex. 1-1 | EP:100 | 25 | 45 | PP/PE:100 | 35 | 6,540 | 730 | 38 | 42 | 361 | 49 |
| Comp. ex. 1-2 | EP:100 | 25 | 45 | PP/PE:100 | 35 | 6,540 | 730 | 38 | 42 | 361 | 49 |
| Comp. ex. 1-3 | EP:100 | 25 | 45 | PP/PE:100 | 35 | 6,540 | 730 | 38 | 42 | 361 | 49 |
| Ex. 2 | PP/PE:15, PET:85 | 20 | 30 | PP/PE:100 | 15 | 3,150 | 410 | 65 | 72 | 99 | 16 |

TABLE 1-continued

| | | | | | | | | | | | |
|---|---|---|---|---|---|---|---|---|---|---|---|
| Comp. ex. 2 | PP/PE:12, PET:88 | 20 | 30 | PP/PE:100 | 15 | 3,150 | 410 | 65 | 72 | 99 | 16 |
| Ex. 3 | PP/PE:100 | 10 | 30 | PP/PE:15, PET:85 | 35 | 990 | 125 | 85 | 88 | 24 | 4 |
| Comp. ex. 3 | PP/PE:100 | 10 | 30 | PP/PE:12, PET:88 | 35 | 810 | 105 | 87 | 88 | 20 | 4 |
| Ex. 4-1 | PET/PE:100 | 5 | 10 | PET/PE:50, PET:50 | 15 | 2,080 | 260 | 31 | 34 | 141 | 21 |
| Ex. 4-2 | PET/PE:100 | 5 | 80 | PET/PE:50, PET:50 | 15 | 2,080 | 260 | 31 | 34 | 141 | 21 |
| Comp. ex. 4 | PET/PE:100 | 5 | 0/90 | PET/PE:50, PET:50 | 15 | 2,080 | 260 | 31 | 34 | 141 | 21 |
| Ex. 5 | PP/PE:100 | 25 | 45 | PP/PE:100 | 70 | 8,520 | 9,150 | 72 | 68 | 249 | 377 |

| | Reinforced non-woven fabric | | | | | | | | |
|---|---|---|---|---|---|---|---|---|---|
| | METSUKE | Tenacity (g/5 cm) | | Elongation (%) | | Tention at 1% elongation (g/5 cm) | | Bending | Peel |
| Example | (g/m²) | Lengthwise | Transverse | Lengthwise | Transverse | Lengthwise | Transverse | resistance | resistance |
| Ex. 1 | 36.5 | 7,800 | 2,010 | 39 | 40 | 365 | 52 | Good | → |
| Comp. ex. 1-1 | 36.5 | 7,520 | 1,980 | 38 | 41 | 368 | 47 | Good | Poor |
| Comp. ex. 1-2 | 36.5 | 5.180 | 1,690 | 42 | 42 | 350 | 55 | Bad | → |
| Comp. ex. 1-3 | 36.5 | 17,500 | 11,680 | 20 | 20 | 1,190 | 969 | Poor | Good |
| Ex. 2 | 17.7 | 4,490 | 1,660 | 48 | 45 | 98 | 16 | Good | → |
| Comp. ex. 2 | 17.5 | 4,380 | 1,710 | 47 | 48 | 100 | 15 | Good | Bad |
| Ex. 3 | 40.2 | 3,900 | 2,720 | 72 | 66 | 27 | 7 | Good | → |
| Comp. ex. 3 | 40.2 | 3,720 | 2,800 | 73 | 64 | 28 | 8 | Good | Bad |
| Ex. 4-1 | 24.7 | 10,660 | 2,420 | 32 | 83 | 543 | 21 | Good | → |
| Ex. 4-2 | 24.6 | 4,220 | 8,900 | 70 | 33 | 137 | 347 | Good | → |
| Comp. ex. 4 | 24.4 | 7,440 | 5,660 | 28 | 30 | 424 | 239 | Bad | Good |
| Ex. 5 | 75.0 | 11,450 | 11,760 | 66 | 60 | 252 | 375 | Good | → |

P = polyethlene
EP = ethlene-propylene copolymer
PET = polyester
PP/PE = (polypropylene/polyethlene)composite fiber
PET/PE = (polyester/polyethlene)composite fiber As is obvious from the property values shown in Table 1, the reinforced non-woven fabric according to the present invention is free from the separation of reinforcing fibers and excellent in reinforcing effect. At the same time, it holds soft feeling and has proper elongation in the lengthwise and transverse directions, thereby making it possible to absorb tension. Further, according to the process of the present invention, it is possible to obtain the reinforced non-woven fabric which is low in cost and excellent in simplification.

What is claimed is:

1. A reinforced non-woven fabric comprising:

a web containing at least 15% by weight of hot-melt-adhesive composite fiber consisting of a low-melting component and a high-melting component, said low-melting component forming at least a part of the external fiber surface successively;

first reinforcing fibers arranged obliquely to the lengthwise direction of said web; and second reinforcing fibers crossed with said first reinforcing fibers for symmetric arrangement relative to the lengthwise direction of the web;

said first and second reinforcing fibers containing at least 15% by weight of hot-melt-adhesive fiber hot-melt-adhered in the heat treatment conducted for forming the non-woven fabric at a temperature between the melting point of the high-melting component and that of the low-melting component of said hot-melt-adhesive composite fiber;

wherein said first and second hot-melt-adhesive reinforcing fibers, these fibers and web, and the fibers constituting said web are adhered to each other by heat fusion and the reinforcing texture having a diamond pattern constituted by said first and second hot-melt-adhesive reinforcing fibers is at least partly embedded in the non-woven fabric.

2. A process for producing a reinforced non-woven fabric in which a reinforcing texture composed of first reinforcing fibers arranged obliquely to the lengthwise direction of the non-woven fabric and second reinforcing fibers crossed with said first reinforcing fibers for symmetric arrangement relative to the lengthwise direction of the non-woven fabric and the reinforcing fibers themselves, these fibers and the web and the fibers constituting the web are bonded to each other by heat fusion, wherein said process comprising in combination the steps of:

making a reinforcing texture by supplying a plurality of reinforcing fibers containing at least 15% by weight of hot-melt-adhesive fiber to heated nip rolls through drag-in guides mounted on a rotating flexible support means; and laminating said reinforcing texture and the web containing at least 15% by weight of hot-melt-adhesive composite fiber, thereby subjecting the laminate to a heat treatment under pressure.

* * * * *